US005753851A

United States Patent [19]

Jordan et al.

[11] Patent Number: 5,753,851

[45] Date of Patent: May 19, 1998

[54] SPINNING MINE WITH CONCENTRATED PROJECTILES

[75] Inventors: Debbee J. Jordan, Valhermoso Springs; Travis S. Taylor, Somerville, both of Ala.

[73] Assignee: The United States of America as represented by the Secretary of the Army, Washington, D.C.

[21] Appl. No.: 876,665

[22] Filed: Jun. 16, 1997

[51] Int. Cl.[6] ..... F42B 23/00

[52] U.S. Cl. ..... 102/427; 102/213; 102/401; 102/404; 102/492; 102/494

[58] Field of Search ..... 102/213, 305, 102/375, 389, 393, 394, 401, 404, 405, 427, 475, 489, 492, 494–497, 499

[56] References Cited

U.S. PATENT DOCUMENTS

| | | | |
|---|---|---|---|
| 4,160,415 | 7/1979 | Cole | 102/475 |
| 4,232,605 | 11/1980 | Lau | 102/404 |
| 4,627,351 | 12/1986 | Thordarson et al. | 102/213 |
| 4,903,602 | 2/1990 | Skagerlund | 102/213 |
| 4,979,444 | 12/1990 | Schaffl | 102/404 |
| 5,003,885 | 4/1991 | Rudolf et al. | 102/475 |

FOREIGN PATENT DOCUMENTS

| | | | |
|---|---|---|---|
| 2520862 | 8/1983 | France | 102/404 |

*Primary Examiner*—Harold Tudor

*Attorney, Agent, or Firm*—Hugh P. Nicholson; Freddie M. Bush; Hay Kyung Chang

[57] ABSTRACT

The spinning mine has all of its projectiles concentrated in one small area. It is launched from a spring-loaded threaded screw launcher and acquires angular momentum as it ascends into the air from the launcher to a pre-determined detonation altitude. As the mine spins, the detector assembly on board detects the presence and location of potential targets and sends appropriate indicative signals to a microprocessor, also on board. The microprocessor determines therefrom the location of the largest target or the largest cluster of targets in the environment and triggers the detonation of the mine such that the projectiles are jettisoned in a conical pattern toward the largest target or the largest cluster of targets for a more efficient destruction of the targets.

6 Claims, 5 Drawing Sheets

SPINNING MINE WITH CONCENTRATED PROJECTILES

DEDICATORY CLAUSE

The invention described herein may be manufactured, used and licensed by or for the Government for governmental purposes without the payment to us of any royalties thereon.

BACKGROUND OF THE INVENTION

When an anti-personnel land mine is detonated, its shrapnel is usually projected in a full circle with the mine itself as the center of that circle. One land mine in particular known as the "Bouncing Betty" is launched from a spring-loaded launcher approximately two feet into the air before it is detonated. The height of the detonation places the shrapnel of the mine on a more lethal trajectory towards the enemy personnel's vital regions. However, the mine at this height still somewhat uniformly distributes its shrapnel through 360 degrees. Therefore, if the enemy person that caused the detonation was the first or last in a group of enemy personnel, a good half of the shrapnel from the exploded mine would be wasted.

SUMMARY OF THE INVENTION

The spinning mine has all of its projectiles (shrapnel) concentrated on one small area of the mine housing. The mine is launched from a spring-loaded threaded launcher so that as it ascends to its detonation height, the mine acquires angular momentum and spins. As the mine spins, the infrared detector on the mine detects heat emanations from potential targets in the environment and the microprocessor, also on the mine, compares the various infrared signals to determine the location of the largest concentration of the targets. Upon such determination, the microprocessor triggers the detonation of the mine such that the projectiles are jettisoned in the direction of the largest concentration of the targets for a more direct and efficient destruction of the targets. In an alternate embodiment, the infrared detector may be replaced by a laser diode that emits illuminating radiation outwardly as the mine spins and a photo detector that detects radiation reflecting back from the potential targets. The largest concentration of the targets would be indicated by the greatest luminosity of the reflected radiation detected by the photo detector.

DESCRIPTION OF THE PREFERRED EMBODIMENT

Figure 1:
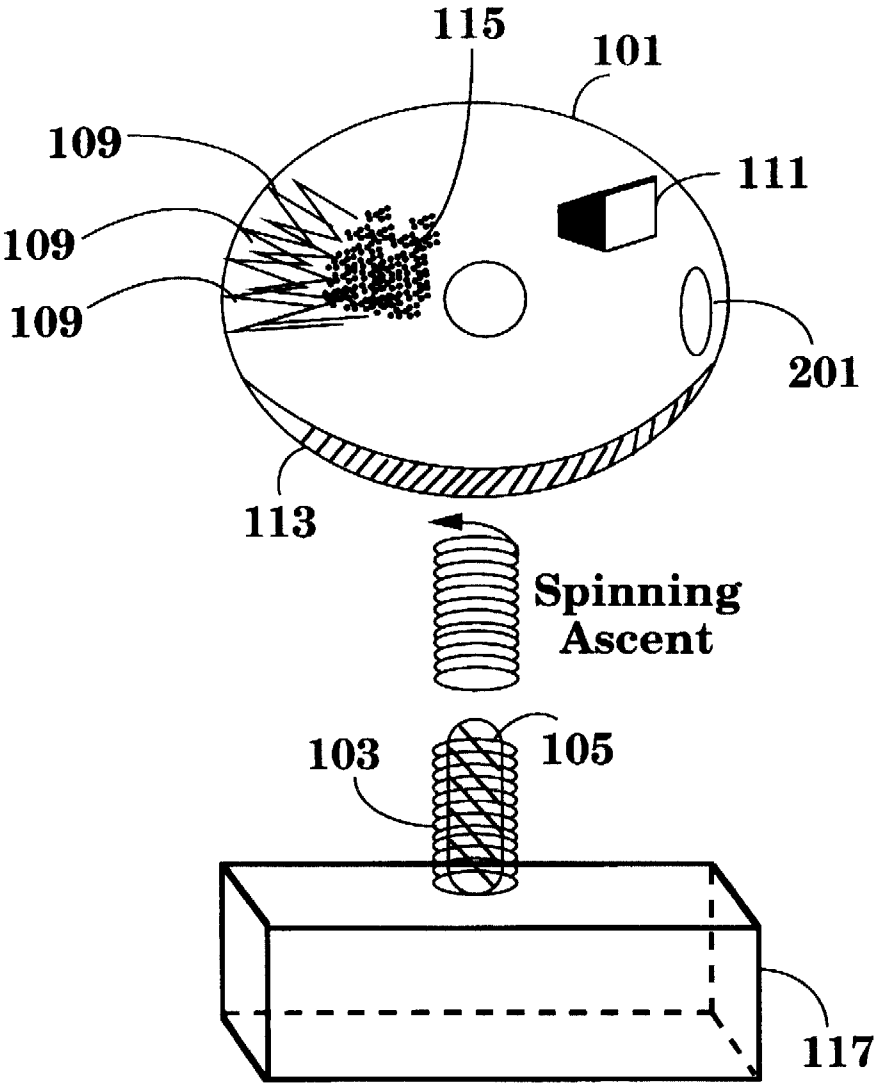
FIG. 1 illustrates the spinning ascension of the mine from a spring-loaded threaded screw launcher.

Referring now to the drawing wherein like numbers represent like parts in each of the figures, the construction and operation of the spinning mine with concentrated projectiles is explained.

Figure 5:
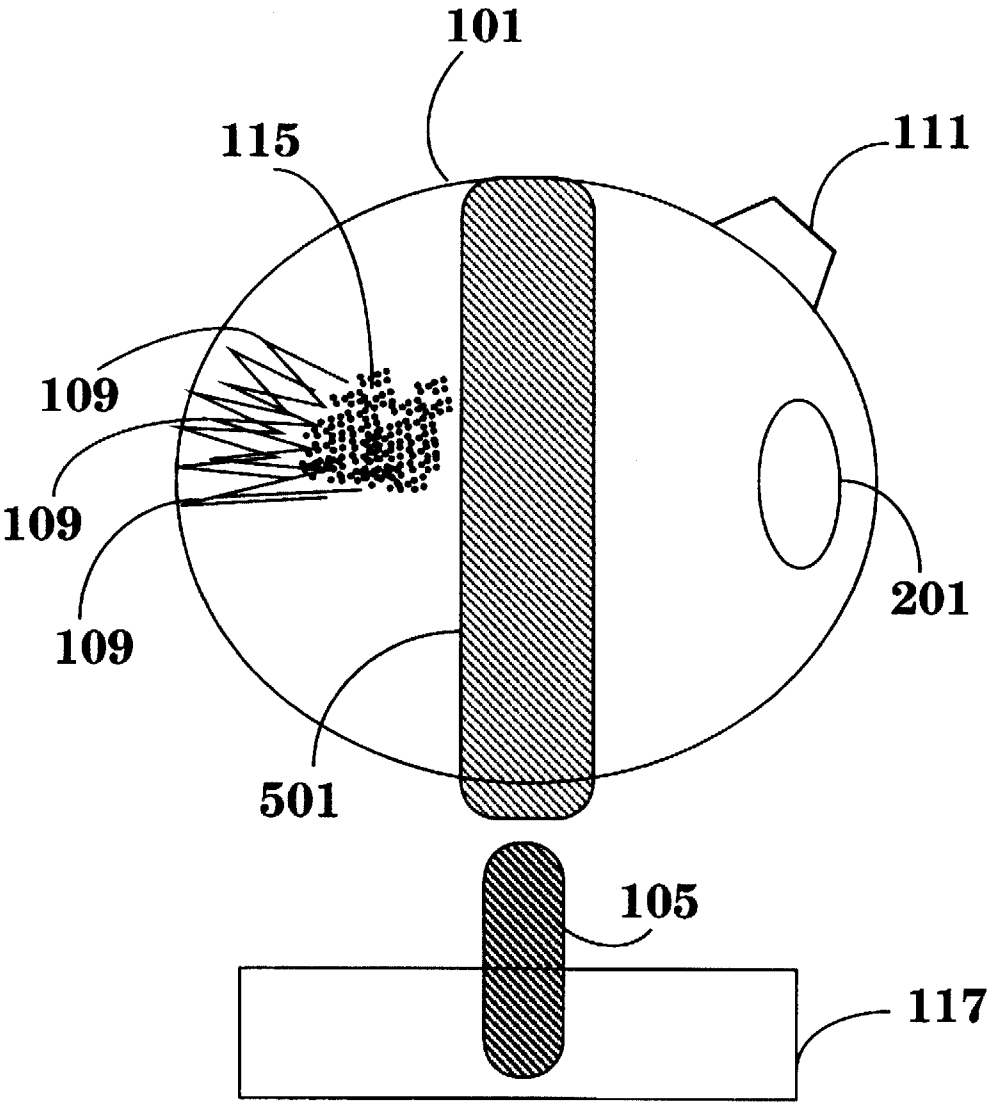
FIG. 5 shows a side view of the spinning mine and the threaded screw launcher.

As depicted in FIG. 5, prior to the launching, invented mine 101 is placed atop threaded screw launcher 105 by screwing the threaded cavity of hollow post 501 of the mine over the screw launcher 105. The mine is launched from the screw launcher (positioned on the launch platform 117, as shown in FIG. 1) when spring 103 that surrounds the launcher ejects the mine upwards. As the mine ascends the length of the launcher, the mine, so to speak, unscrews itself from the launcher, thereby acquiring an angular momentum and keeps on spinning even after becoming completely free of the launcher and reaching a detonation altitude of about two feet up in the air. As mine 101 escapes the screw launcher and continues to spin, the angular momentum is maintained by counter-balancing weight 201. The counter-balancing weight is placed such that it, together with detector assembly 111, balances against the weight of projectiles 109 and explosive material 115 on the opposite side of mine housing 113. Such counter-balance weight can be any piece of metal and may be built into the housing.

Figure 2:
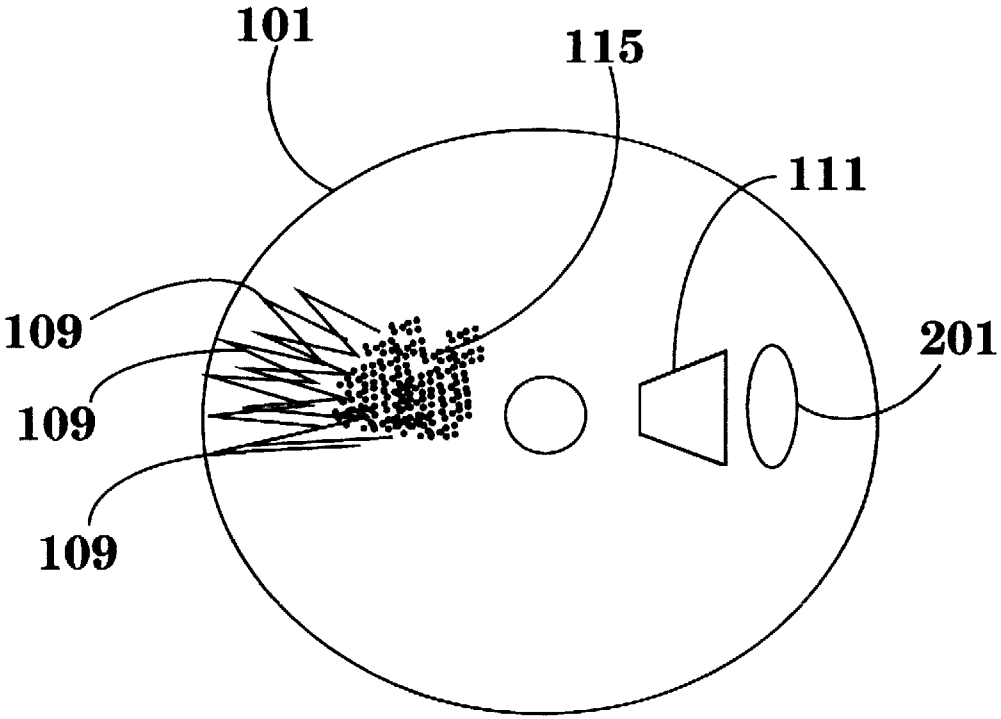
FIG. 2 is a diagram showing the top view of a preferred embodiment of the spinning mine with concentrated projectiles.

As illustrated in FIGS. 1, 2 and 5, all projectiles 109 are concentrated in one small area of the mine enclosed inside explosible housing 113 and are positioned to be jettisoned, upon detonation of the mine, through a small cone in the direction of the largest cluster of targets rather than in a full circular pattern. The detection and determination of the location of such largest cluster of targets is accomplished by detector assembly 111 whose embodiments are shown in FIGS. 3 and 4.

Figure 3:
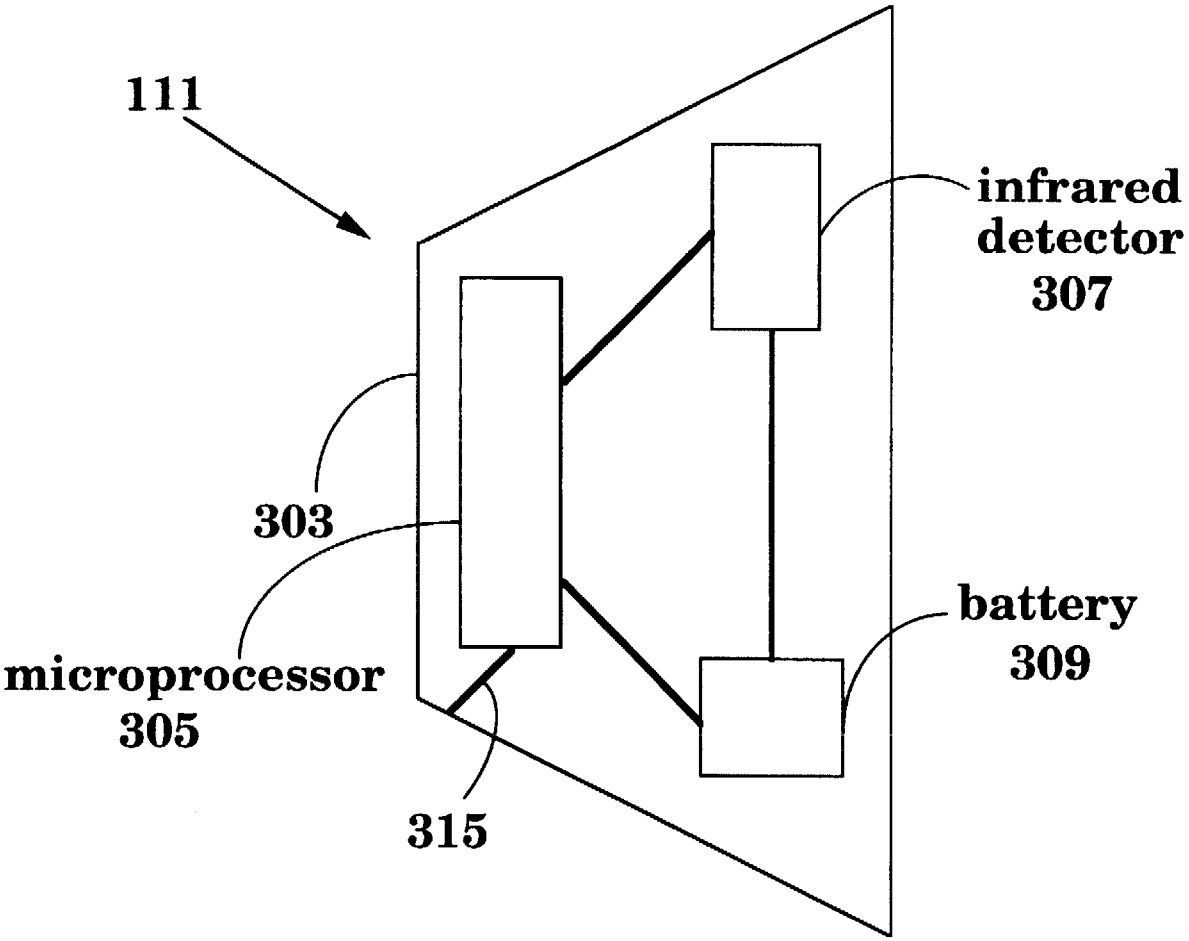
FIG. 3 details the composition of the detector assembly utilizing an infrared detector.

In the embodiment of FIG. 3 which is the preferred one, as soon as mine 101 clears threaded screw launcher 105, battery 309 is activated to deliver power to infrared detector 307 and to microprocessor 305. As the mine continues to spin in the air, infrared detector 307 detects any heat emanation from objects in the surroundings and generates corresponding signals that are indicative of the sizes of the objects or cluster of objects. These signals are input to microprocessor 305 which is pre-programmed with appropriate comparison logic. The microprocessor, then, compares the various infrared signals to determine the location of the largest object (potential target) or cluster of objects (potential targets) and, in response, produces a triggering signal that causes the detonation of the mine when, during the spin, the projectiles are aimed in the direction of the strongest heat emanation. The triggering signal travels via signal path 315, partly shown, to explosive material 115 to cause the explosion thereof and consequently the detonation of the mine itself to jettison the projectiles in a conical pattern toward the largest target or cluster of targets for a more efficient and economical destruction of the targets. The number of spins required prior to the detonation can be programmed into the microprocessor.

Figure 4:
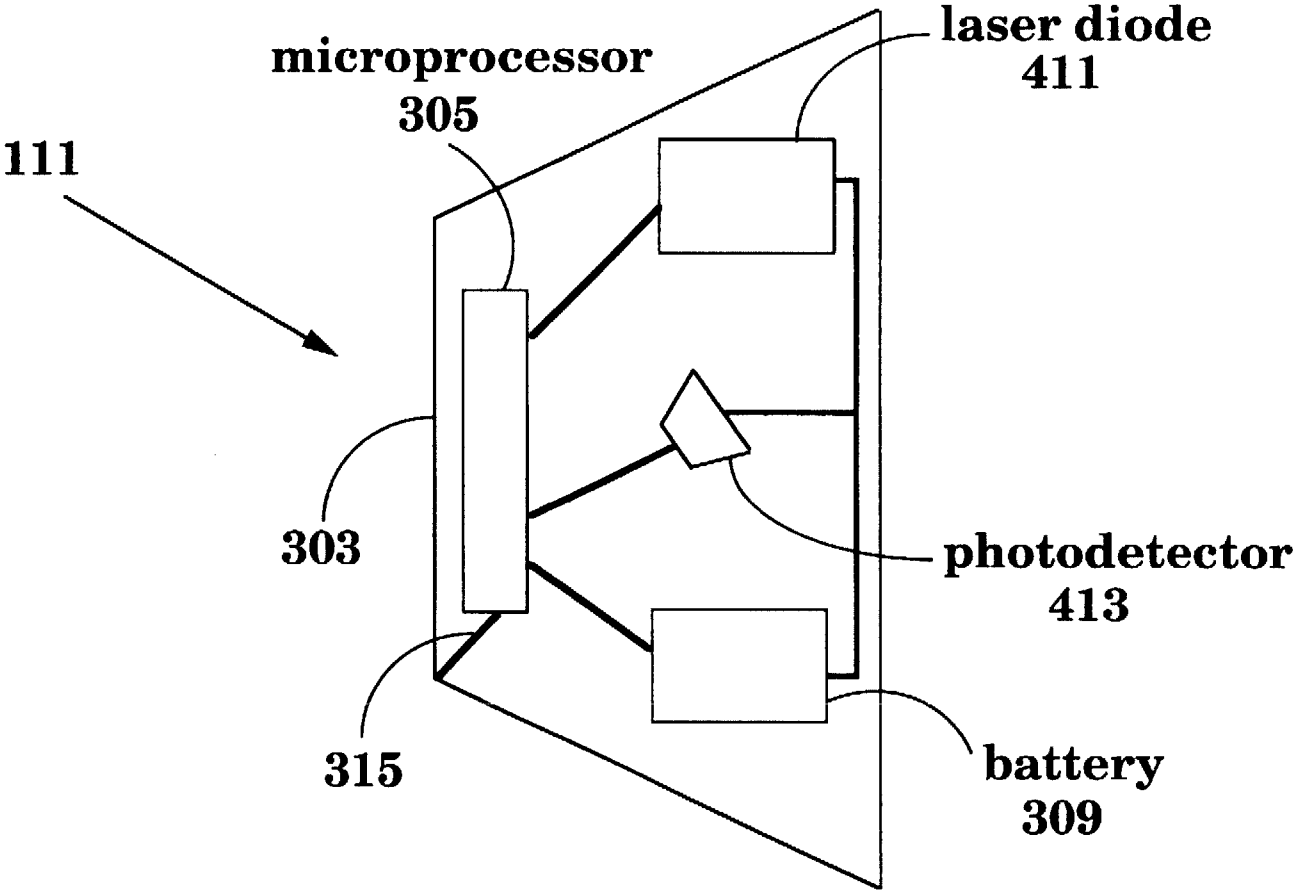
FIG. 4 details the composition of the detector assembly utilizing a laser diode and a photo detector.

As depicted in FIG. 4, an alternative embodiment of detector assembly 111 replaces infrared detector 307 with laser diode 411 and photo detector 413. While the mine spins, the laser diode emits illuminating radiation outwardly toward the surrounding and the photo detector detects any returned radiation that reflects back from potential targets in the surrounding. The signals generated by the photo detector that are indicative of the sizes of the targets are input to microprocessor 305 which, using resident comparison logic, determines the location of the largest target or cluster of targets and produces a triggering signal that detonates the mine so as to direct the concentrated projectiles toward the largest target or cluster of targets. The components of detector assembly 111 may be contained in suitable container 303 for ease of installation into the explosible housing of the mine.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. A spinning mine, said mine being launchable from a spring-loaded threaded screw launcher, said mine being programmed to choose a most lethal direction while spinning, said mine comprising: an explosible housing having a geometrical center; a plurality of projectiles, said projectiles being collected in only a fractional portion of said housing and positioned to be jettisoned outwardly together in a conical pattern upon explosion of said housing; a means contained within said housing for determining the most lethal trajectory toward a selected target and producing a triggering signal to aim the ejection of said projectiles in said trajectory; an explosive material positioned only adjacent to said projectiles within said housing to receive said triggering signal from said determining means and explode in response to said signal, thereby causing said housing to explode and said projectiles to disperse in a conical pattern toward the selected target to wreak the most havoc in an efficient manner, said projectiles and said explosive material being located only on one side of said center; and a hollow, threaded post fixedly attached to said center of said housing, said post being fitted over the threaded screw launcher prior to the launching of said mine such that upon launch, said mine threads upwards along the length of said launcher acquiring an angular momentum and spins as said mine ascends further into the air to a given detonation altitude.

2. A spinning mine as described in claim 1, wherein said mine further comprises a counter-balancing weight, said weight being placed within said housing so as to balance against said projectiles and explosive material and enable said mine to maintain its angular momentum as it spins.

3. A spinning mine as described in claim 2, wherein said trajectory determining means comprises an infrared detector for detecting heat emanation from a plenitude of potential targets as said mine spins and generating signals indicative of the magnitudes of said potential targets; a microprocessor, said microprocessor being coupled to said infrared detector and receiving from said infrared detector said indicative signals and comparing said indicative signals to determine the location of the target that corresponds to the strongest of the indicative signals and generating said triggering signal; a battery coupled to supply power simultaneously to said infrared detector and said microprocessor, said battery being activated upon the release of said mine from the threaded screw launcher; and a means for transmitting said triggering signal from said microprocessor to said explosive material to accomplish the detonation of said mine and subsequent jettisoning of said projectiles in a conical pattern in the direction of the target corresponding to said strongest of the indicative signals for a more concentrated and lethal effect.

4. A spinning mine as described in claim 2, wherein said trajectory determining means comprises a laser diode for emitting illuminating radiation outwardly toward a plenitude of potential targets as said mine spins; a photo detector for detecting reflected radiation from said potential targets and producing clusters of light spots indicative of the magnitudes of said potential targets; a microprocessor coupled to said photo detector, said microprocessor receiving said clusters and comparing said clusters to determine the location of the target that corresponds to the largest of said clusters and generating said triggering signal; a battery coupled simultaneously to said laser diode, photo detector and said microprocessor, said battery being activated upon the release of said mine from the threaded screw launcher; and a means for transmitting said triggering signal from said microprocessor to said explosive material to accomplish the detonation of said mine and subsequent jettisoning of said projectiles in a conical pattern in the direction of the target that corresponds to said largest of said clusters for a more concentrated and lethal effect.

5. A spinning mine as described in claim 3, wherein said mine still further comprises a container, said container holding therein said infrared detector, microprocessor and said battery, said container further having a window positioned to allow the receipt by said infrared detector of heat emanation from said potential targets.

6. A spinning mine as described in claim 4, wherein said mine still further comprises a container, said container being affixed to said explosible housing and holding therein said laser diode, photo detector, microprocessor and battery, said container further having a window positioned to allow the outward transmission of laser beam from said laser diode and receipt by said photo detector of reflected radiation from said potential targets.

* * * * *